United States Patent [19]

Chedgy

[11] Patent Number: 4,854,941

[45] Date of Patent: Aug. 8, 1989

[54] METHOD AND APPARATUS FOR DRYING FINE COAL

[75] Inventor: David G. Chedgy, Pittsburgh, Pa.

[73] Assignee: CLI International Enterprises, Inc., Pittsburgh, Pa.

[21] Appl. No.: 180,303

[22] Filed: Apr. 12, 1988

[51] Int. Cl.[4] ..... C10L 5/00; C10L 9/08

[52] U.S. Cl. ..... 44/626; 44/629; 34/133

[58] Field of Search ..... 44/626, 629; 34/82, 34/24, 131, 133, 139

[56] References Cited

U.S. PATENT DOCUMENTS

| | | | |
|---|---|---|---|
| 2,136,870 | 11/1938 | Vissac | 44/626 |
| 3,982,052 | 9/1976 | Bearce | 44/629 |
| 4,617,744 | 10/1986 | Siddoway et al. | 44/626 |

FOREIGN PATENT DOCUMENTS

| | | | |
|---|---|---|---|
| 2712 | of 1855 | United Kingdom | 44/626 |

*Primary Examiner*—Carl F. Dees

*Attorney, Agent, or Firm*—Walter J. Blenko, Jr.

[57] ABSTRACT

Methods and apparatus for drying fine coal including a heating member within a drying chamber, tumbling and agitating the coal, and allowing dried coal to escape from a drying zone through screens.

10 Claims, 2 Drawing Sheets

METHOD AND APPARATUS FOR DRYING FINE COAL

This invention relates to drying of fine coal by heating the coal to remove moisture. More particularly, it relates to drying coal by heating and agitating the coal and passing it over a screen until the coal has dried to an extent that it will pass through the screen.

The problems of handling wet fine coal are old and well-known. When coal fines are wet, they tend to clump and agglomerate with the result that they cannot be handled as discrete particles. For example, when it is attempted to screen wet coal fines, they tend to bridge over the openings in screen wire and blind the screen. Prior efforts to dry such coals which are known to me have required expensive apparatus, have required high energy consumption, and have produced substantial quantities of dust. Moreover, such apparatus presents serious control problems and often is difficult to utilize at varying feed rates.

I provide a tubular rotatable drying chamber and a rotatable heating member positioned within the drying chamber. I prefer to provide a drying chamber in the form of a tubular member which is mounted substantially horizontally and is rotatable about its axis. I further prefer to provide a tubular heating member which is positioned within the drying chamber and which is aligned therewith. I provide screen means in the wall of the drying chamber. A coal-drying zone is formed between the wall of the drying chamber and the heating member. I provide a port for delivery of wet coal to the coal-drying zone. Preferably, wet coal is delivered to a top surface of the heating member while it is rotated about its axis. I further provide heat generating means in flow connection with the heating member whereby heat is supplied to the heating member and thereby to coal in the drying zone. I prefer to provide a body member which surrounds the drying chamber and which prevents the escape of heat, moisture, and coal fines into the atmosphere. I further provide a coal outlet and a moisture outlet from the dryer body. I prefer to provide means for circulation of heated gas through the heating member, for recirculation of gas from the heating chamber, and for addition of heated gas to make up for heat loss to the coal in the coal-drying zone.

I prefer to deliver wet coal to the top of the heating member and to tumble and agitate the coal by rotation of the heating member. The tumbled and agitated coal drops to the wall of the drying chamber which is rotated thereby tumbling and agitating the wet coal and depositing it on an upper surface of the heating member. I prefer to provide inclinded flight bars associated with at least one of the drying chamber and the heating member whereby rotation thereof advances the coal through the heating zone away from the feed end. The repeated transfer of the wet coal between the heating member and the wall of the drying chamber as the coal advances through the heating zone causes the coal clumps to be broken up and the surface areas of the wet coal fines to be exposed to heat for evaporation of moisture therefrom. When the coal is excessively wet, the screen walls of the drying chamber will blind over and coal will not pass therethrough. As the coal advances along the length of the coal-drying zone and loses moisture, it will become drier and will pass through the screened areas. Thus, as the coal reaches a desired moisture content, it automatically leaves the coal-drying zone through the screens where it is collected for further transport or processing.

In the accompanying drawings, I have illustrated a present preferred embodiment of my invention which FIG. 1 is a side elevational view of a coal drier embodying my invention;

Figure 1:
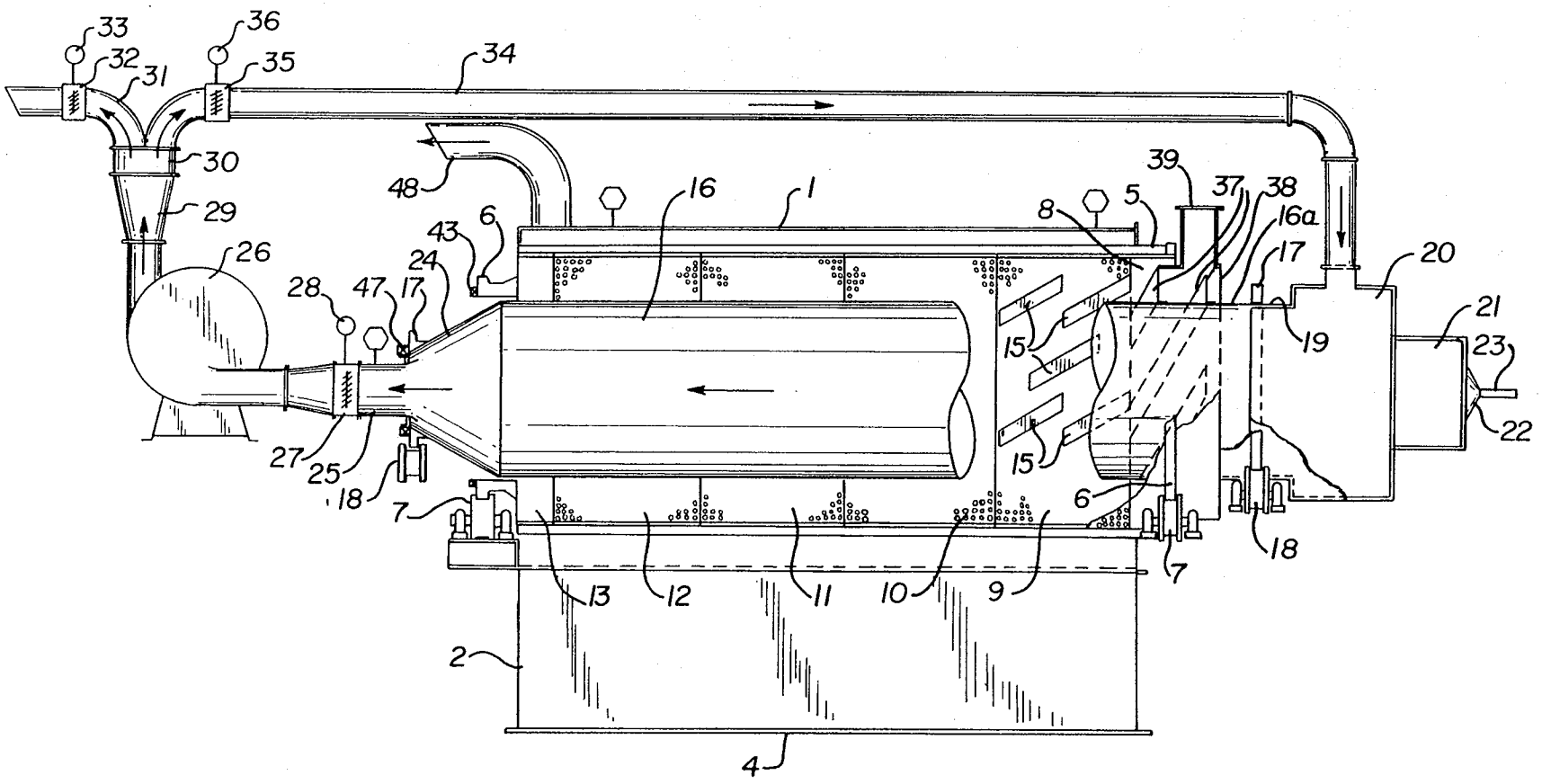
Figure 2:
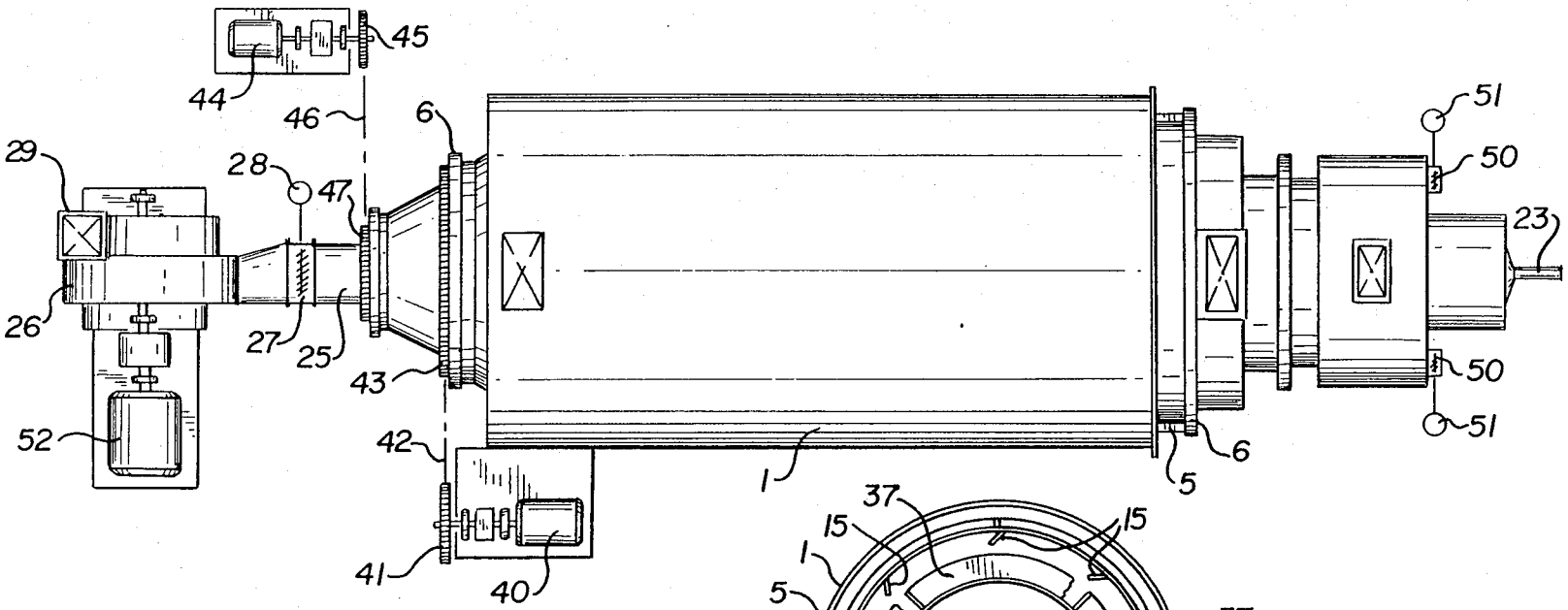
FIG. 2 is a top plan view of the apparatus shown in FIG. 1.
Figure 3:
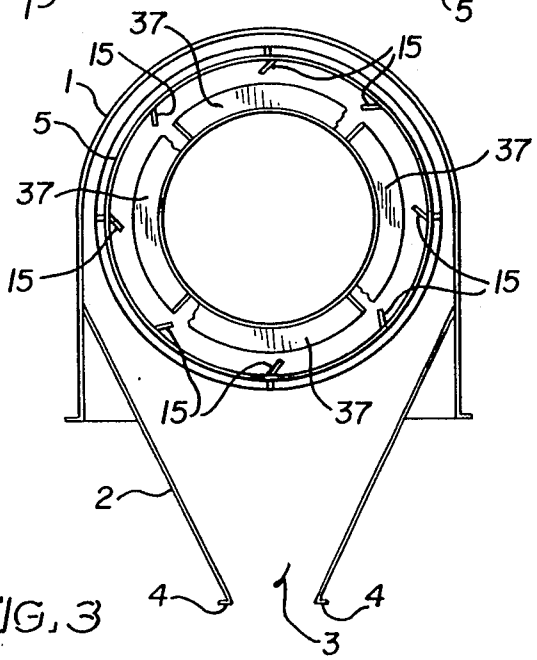
FIG. 3 is a sectional view taken along line 3—3 of FIG. 1 with some details being omitted for clarity of illustration.

The coal drier has a drier body 1 which is mounted in the desired location. The drier body 1 surrounds the area in which drying of wet coal takes place. A discharge chute 2 extends from end to end of the drier body on the bottom of drier body 1 and terminates in a restricted outlet 3. A conveyor is provided beneath outlet 3 to remove dried coal from the drier to the point of use. A flange 4 positioned at each edge of outlet 3 may serve for mounting the drier body to a support.

A tubular drying chamber 5 is rotatably mounted on a horizontal axis within drier 1. A cylindrical wheel 6 is formed at each end of drying chamber 5. Each wheel 6 is carried by a pair of spaced rollers 7 at each end of the drying chamber. Rollers 7 are carried by the supporting structure and are journaled for rotation so that the drying chamber can be rotated on its axis by rolling contact of wheels 6 on rollers 7.

The wall of drying chamber 5 comprises a solid circumferential panel 8 adjacent a coal feed end and a plurality of circumferential screen panels 9, 10, 11, and 12 which form a continuous wall extending from panel 8. A circumferential area 13 at the end of drying chamber 5 opposite the feed end and adjacent screen panel 12 is open. A series of inclined flight bars 15 are welded to the screen panels around the circumference of the drying chamber. The bars are at an angle to the axis of the chamber, i.e., in a helical pattern, so that when the chamber is rotated the flight bars will tend to advance coal from the feed end to the opposite end. The screen sizes in panels 9, 10, 11, and 12 may have different sized openings within them.

A heating tube 16 is positioned axially within drying chamber 5. Heating tube 16 has a wheel 17 at each end with each wheel rotating in a pair of journaled rollers 18 mounted on the foundation. One end of heating tube 16 is open at **16*a* and telescopically fits over an outlet 19 of a hot air chamber 20. A firebox 21 is fitted to another side of hot air chamber 20 and is provided with a burner 22 connected to a gas supply 23. Air dampers 50 operated by motors t1 admit ambient air to the fire box. The opposite end of heating tube 16 is tapered at 24 and telescopically fits to a duct 25. The other end of duct 25 is connected to the suction of a centrifugal fan 26 driven by motor 52. An air damper 27 operated by a motor 28 is positioned in duct 25. A discharge duct 29 from fan 26 leads to a Y 30. One branch of Y 30 leads to a duct 31 which exhausts to the atmosphere. Flow of gas through duct 31 is controlled by a damper 32 operated by motor 33. The other branch of Y 30 is connected to a duct 34 which extends from Y 30 to a hot air chamber 20. Flow of gas in duct 34 is controlled by a damper 35 operated by a motor 36**.

A series of flight bars 37 are welded to the outside of heating tube 16 in a helical pattern. For clarity of illustration, flight bars 37 are shown in the drawings adjacent to the material feed end of the drier only. They are preferably extended for a substantial length of the drier in a helical pattern.

A coal feed box 38 is provided at the fire box end of the drier. Feed box 38 closely surrounds heating tube 16 and telescopically extends into the adjacent end of drying chamber 5. A coal feed port 39 is provided at the top of feed box 38.

A motor 40 drives a sprocket 41 which is connected by chain 42 to a sprocket 43 on drying chamber 5. A motor 44 drives a sprocket 45 which is connected by chain 46 to a sprocket 47 on heating tube 16.

A moisture exhaust vent 48 is fitted to an upper portion of drier body member 1 for removal of moisture from the drier.

In operation, fuel is supplied at 23 to burner 22 and air is heated in chamber 20. Fan 26 is driven to pull heated air through heating tube 16. The air in chamber 20 is partially cooled as it passes through heating tube 16 but is still at a temperature above ambient temperature. The hot air is recirculated through duct 34 to return to hot air chamber 20. Some of the hot air being discharged by fan 26 is diverted to the atmosphere through duct 31. The amount of air discharged through duct 31 balances the combustion air being introduced through burner 22 and air dampers 50.

Wet coal fines introduced through opening 39 into feed box 38 where the coal is deposited on the top of heating tube 16 between adjacent flight bars 27. Because of the moisture content, the coal fines agglomerate in clumps. As heating tube 16 rotates, driven by motor 44, the wet coal is carried over the side of heating tube 16. The coal clumps are tumbled and broken up by the action of flight bars 37 and falls to the bottom of drying member 5. Rotation of drying chamber 5 and flight bars 15 will carry the wet coal upward until it drops onto and between flight bars 37 on heating member 16. By reason of the helical configuration of flight bars 15 and 37, the coal will be advanced from the feed end toward the opposite end of the drier. The coal will be repeatedly agitated and tumbled and will pick up heat from the heating tube. As it does so, moisture in the coal will pass to the vapor phase and is removed through duct 48.

When the coal is in its wet state as delivered to the drier, it will tend to bridge across and blind the screen sections 9, 10, 11, and 12. As the coal fines are dried through the tumbling action and the application of heat, they will reach a condition in which they will pass through screen wire of a particular size. By using a selected mesh in the panels 9, 10, 11, and 12, an equilibrium condition can be obtained in which coal which has been dried from the wet raw feed to coal of a desired moisture content will pass through the screen panels. The coal which passes through the screens will pass down discharge chute 2 and through orifice 3 to a conveyor belt or the like. In the event that the drying process does not proceed as intended and the screens become blinded, coal will overflow past screen panel 12 through the open area 13 and will pass from the drier without rendering the drier inoperative.

It will be seen that the drier is able to dry a wet coal feed comprising fine particles and still to achieve 100% recovery rate without loss such as might be experienced in a wet process employing vacuum filters and thickeners. A minimum amount of dust is produced and no energy is required for a high velocity scrubber to remove fines from the air. The maximum moisture content of fine coal which will pass through a particular screen mesh may readily be determined. By using screen panels of that mesh, the moisture content of the dried coal may be easily regulated since the coal will pass from the drier as soon as its moisture content is reduced to the value associated with the screen. Accordingly, a consistent moisture content is produced in the delivered coal without the necessity of elaborate controls and sensing devices. The control is automatic over any desired feed rate within the total capacity of the drier. Accordingly, the drier may be operated from very light load to full capacity while obtaining a dried product having a moisture content within a narrow and predetermined range. The apparatus is simple and cheap to manufacture. Because, it avoids the expense and energy requirements of high speed scrubbers and fluid bed technology, it is cheap to operate.

While I have illustrated and described a present preferred embodiment of my invention, it is to be understood that I do not limit myself thereto and that my invention may be otherwise variously practiced within the scope of the following claims.

I claim:

1. Coal drying apparatus comprising a rotatable drying chamber, a rotatable heating member positioned within the drying chamber, and forming a coal drying zone therebetween, screen openings in the wall of the drying chamber, and moisture exhaust means from the drying chamber.

2. Coal drying apparatus comprising a tubular rotatable drying chamber, screen openings in the wall of the drying chamber, a tubular rotatable heating member positioned within the drying chamber, a coal delivery port for introduction of coal to a coal drying zone between the heating member and the wall of the drying chamber, heat generating means in flow connection with the heating member, and flight means mounted on at least one of the heating member and the drying chamber in the zone therebetween.

3. Coal drying appartus comprising a cylindrical tubular drying chamber mounted for rotation about its axis, screen openings in the wall of the drying chamber, a cylindrical tubular heating member mounted within the drying chamber for rotation about the axis of the heating member, the drying chamber and the heating means forming a coal drying zone therebetween, gas conduit means in flow communication with the interior of the heating chamber for movement of heated gas through the heating chamber, and a coal delivery port positioned above the heating member for discharge of wet coal into the heating chamber.

4. Coal drying apparatus of claim 3 having flight means affixed to at least one of the drying chamber and the heating member in the coal drying zone.

5. Coal drying apparatus of claim 3 in which the gas conduit means includes a conduit for recirculation of heated gas through the interior of the heating member.

6. Coal drying apparatus of claim 5 having different size screen openings in the wall of the drying chamber.

7. Coal drying apparatus of claim 6 having a body member surrounding the drying chamber and a moisture exhaust from the body member.

8. Coal drying apparatus of claim 7 having drive means in driving relationship to the drying chamber and heating means for rotation thereof.

9. The method of drying wet coal which comprises delivering the wet coal fines to a drying zone formed between a heating member and a screen member where the wet coal contacts the heating member and acquires heat therefrom and tumbling the coal in the drying zone while transferring the wet coal between the heating means and the screen means whereby the coal is heated and dried to an extent that it will pass through the screen means for exit from the drying zone.

10. The method of drying out coal which comprises delivering wet coal to a coal drying zone formed between a heating member rotatable about its axis and screen means, tumbling and agitating the coal while transferring the wet coal between the heating means and the screen means, and collecting coal which passes through the screen means.

* * * * *

UNITED STATES PATENT AND TRADEMARK OFFICE

CERTIFICATE OF CORRECTION

PATENT NO. : 4,854,941

DATED : August 8, 1989

INVENTOR(S) : David G. Chedgy

It is certified that error appears in the above-identified patent and that said Letters Patent is hereby corrected as shown below:

On the title page:
Under Foreign Patent Documents, "2712 of 1855" should be --2712 12/1855--.

Column 1, line 53, "inclinded" should be --inclined--.

Column 2, line 4, --in-- should be inserted after "invention"; line 22, --body-- should be inserted after "drier"; line 62, delete "a" after "to".

Signed and Sealed this

Fifth Day of June, 1990

*Attest:*

HARRY F. MANBECK, JR.

*Attesting Officer*

*Commissioner of Patents and Trademarks*